US009732994B2

(12) United States Patent
Sedlak et al.

(10) Patent No.: US 9,732,994 B2
(45) Date of Patent: Aug. 15, 2017

(54) DEVICE AND METHOD FOR AN EFFICIENT SURFACE EVAPORATION AND FOR AN EFFICIENT CONDENSATION

(71) Applicant: EFFICIENT ENERGY GMBH, Sauerlach (DE)

(72) Inventors: Holger Sedlak, Lochhofen/Sauerlach (DE); Oliver Kniffler, Munich (DE)

(73) Assignee: Efficient Energy GmbH, Sauerlach (DE)

( * ) Notice: Subject to any disclaimer, the term of this patent is extended or adjusted under 35 U.S.C. 154(b) by 174 days.

(21) Appl. No.: 14/085,747

(22) Filed: Nov. 20, 2013

(65) Prior Publication Data

US 2014/0075978 A1 Mar. 20, 2014

Related U.S. Application Data

(60) Division of application No. 12/976,230, filed on Dec. 22, 2010, now abandoned, which is a continuation of (Continued)

(30) Foreign Application Priority Data

Jun. 23, 2008 (DE) ..... 10 2008 029 597
Jul. 2, 2008 (DE) ..... 10 2008 031 300

(51) Int. Cl.
*F25B 27/00* (2006.01)
*F25B 30/02* (2006.01)

(Continued)

(52) U.S. Cl.
CPC ..... *F25B 30/02* (2013.01); *F25B 39/00* (2013.01); *F28F 13/12* (2013.01); *F28F 13/182* (2013.01)

(58) Field of Classification Search
CPC ..... F28F 13/182; F28F 13/12; F28F 13/02; F28F 13/04; F28F 13/06; F28F 13/185;

(Continued)

(56) References Cited

U.S. PATENT DOCUMENTS 2,321,964 A 6/1943 Zieber et al.
3,175,962 A 3/1965 Holtslag (Continued)

FOREIGN PATENT DOCUMENTS

CH 378290 7/1964
DE 245032 4/1987

(Continued)

*Primary Examiner* — Len Tran
*Assistant Examiner* — Ana Vazquez
(74) *Attorney, Agent, or Firm* — Michael A. Glenn; Perkins Coie LLP

(57) ABSTRACT

An evaporator or a condenser includes a surface on which the operating liquid is arranged. Further, turbulence generators are provided to generate turbulences in the operating liquid located on the operating surface. In the condenser, alternatively or additionally, a laminarizer is present to make the vapor stream laminar provided by the compressor. On the evaporator side, the evaporation efficiency is increased and, on the condenser side, the condenser efficiency is increased, which may be used for a substantial reduction in size without loss of power of these components, in particular for a heat pump for heating a building.

18 Claims, 9 Drawing Sheets

Related U.S. Application Data application No. PCT/EP2009/004519, filed on Jun. 23, 2009.

(51) Int. Cl.
*F25B 39/00* (2006.01)
*F28F 13/12* (2006.01)
*F28F 13/18* (2006.01)

(58) Field of Classification Search
CPC ..... F28F 13/187; F25B 39/00; F25B 39/04; F25B 30/02
USPC ..... 165/109.1, 133, 911, 913
See application file for complete search history.

(56) References Cited

U.S. PATENT DOCUMENTS

| | | | | |
|---|---|---|---|---|
| 3,279,525 | A | 10/1966 | Takahashi | |
| 3,438,711 | A * | 4/1969 | Hell | G01N 21/72 239/552 |
| 4,638,642 | A * | 1/1987 | Tokuno | 62/498 |
| 4,898,152 | A * | 2/1990 | Kahl | F24D 17/0021 122/381 |
| 5,154,227 | A | 10/1992 | Csaba et al. | |
| 5,428,966 | A * | 7/1995 | Alsenz | F25B 1/00 62/116 |
| 5,458,191 | A * | 10/1995 | Chiang et al. | 165/133 |
| 5,590,537 | A | 1/1997 | Vogel | |
| 5,992,512 | A | 11/1999 | Tsuri et al. | |
| 6,018,963 | A | 2/2000 | Itoh et al. | |
| 6,341,647 | B1 * | 1/2002 | Nobuta et al. | 165/132 |
| 6,655,207 | B1 * | 12/2003 | Speldrich et al. | 73/202.5 |
| 7,121,328 | B1 | 10/2006 | McDonald et al. | |
| 7,841,201 | B2 | 11/2010 | Sedlak et al. | |
| 2004/0231351 | A1 | 11/2004 | Wyatt et al. | |
| 2005/0274139 | A1 | 12/2005 | Wyatt | |
| 2007/0245759 | A1 | 10/2007 | Sedlak et al. | |
| 2009/0217680 | A1 | 9/2009 | Petersen | |
| 2009/0293515 | A1 * | 12/2009 | Lifson et al. | 62/117 |
| 2011/0100032 | A1 | 5/2011 | Sedlak et al. | |
| 2011/0146316 | A1 | 6/2011 | Sedlak et al. | |
| 2012/0180987 | A1 * | 7/2012 | Koch | 165/96 |

FOREIGN PATENT DOCUMENTS

| | | | |
|---|---|---|---|
| DE | 10310748 | | 8/2004 |
| DE | 102005032266 | | 9/2009 |
| EP | 0429375 | | 5/1991 |
| JP | S50-153112 | | 12/1975 |
| JP | S50-142906 | | 12/1977 |
| JP | S62-156208 | | 10/1987 |
| JP | H01-217168 | | 8/1989 |
| JP | H01-305292 | | 8/1989 |
| JP | H04-254188 | A | 9/1992 |
| JP | 04-316972 | | 11/1992 |
| JP | H08-075384 | | 3/1996 |
| JP | H09-119692 | | 5/1997 |
| JP | 2001-050618 | | 2/2001 |
| JP | 2001-153503 | | 6/2001 |
| JP | 2004293872 | A | 10/2004 |
| JP | 2009-532655 | A | 9/2009 |
| WO | WO-92/15833 | | 9/2002 |
| WO | WO-03/089865 | | 10/2003 |
| WO | WO-2007/118482 | | 10/2007 |

* cited by examiner (TOP VIEW)

(LONGITUDINAL SECTION)

(TOP VIEW)

(SECTIONAL VIEW)

DEVICE AND METHOD FOR AN EFFICIENT SURFACE EVAPORATION AND FOR AN EFFICIENT CONDENSATION

CROSS-REFERENCE TO RELATED APPLICATIONS

This application is a divisional of copending U.S. application Ser. No. 12/976,230, filed Dec. 22, 2010, which is a continuation of copending International Application No. PCT/EP2009/004519, filed Jun. 23, 2009, both of which are incorporated herein by reference in their entirety, and additionally claims priority from German Applications Nos. DE 102008029597.3, filed Jun. 23, 2008 and DE 10 2008 031 300.9, filed Jul. 2, 2008, which are all incorporated herein by reference in their entirety.

BACKGROUND OF THE INVENTION

The present invention relates to evaporating or condensing on surfaces and in particular to an application of evaporating and condensing to surfaces in heat pumps.

A liquid layer, as it, for example, occurs in an evaporator of a heat pump, executes, due to the typical layering which may be observed with liquids and in particular with water as an operating liquid, a heat distribution which means that in the evaporator the top portion is cooled while the bottom portion of the layer virtually has the same temperature as the operating liquid as it is supplied from a heat source.

With condensers for heat pumps the situation is similar. Here, the compressed and thus heated-up vapor of operating liquid, like, for example, water vapor, when water is used as the operating liquid, meets a "cold" liquid layer. This leads to only the surface of the liquid layer being heated up in the condenser while the bottom portion of the liquid layer in the condenser which is not directly in contact with the vapor is not heated up.

Apart from that, with the evaporator of a heat pump there is still the problem that the compressed and heated-up vapor may be overheated, which means that in spite of the fact that the vapor meets the liquid to be heated up the heat transmission from vapor into liquid is limited.

All of these problems lead to the fact that the efficiency when evaporating or condensing is reduced. In order to still generate a heat pump, for example with sufficient power, thus the cross-sectional area of the evaporator or the cross-sectional area of the condenser has to be very large.

SUMMARY

According to one embodiment, an evaporator for evaporating an operating liquid, may have an evaporator surface on which the operating liquid to be evaporated is to be arranged; and a plurality of turbulence generators which are implemented to generate turbulences in the operating liquid to be evaporated on the evaporator surface.

According to another embodiment, a condenser for condensing an evaporated operating liquid may have a condenser surface on which an operating liquid is to be arranged; a plurality of turbulence generators which are implemented to generate current turbulences in the operating liquid located on the condenser surface; or a laminarizer which is implemented to make a vapor current directed to the condenser surface laminar so that a vapor made laminar by the laminarizer impinges on the operating liquid.

Another embodiment may be an evaporator or condenser, wherein the operating liquid is water.

According to another embodiment, a heat pump may have an evaporator for evaporating an operating liquid which may have an evaporator surface on which the operating liquid to be evaporated is to be arranged; and a plurality of turbulence generators which are implemented to generate turbulences in the operating liquid to be evaporated on the evaporator surface; a condenser for condensing an evaporated operating liquid, which may have a condenser surface on which an operating liquid is to be arranged; a plurality of turbulence generators which are implemented to generate current turbulences in the operating liquid located on the condenser surface; or a laminarizer which is implemented to make a vapor current directed to the condenser surface laminar so that a vapor made laminar by the laminarizer impinges on the operating liquid; and a compressor for compressing operating liquid evaporated by the evaporator, wherein the compressor is coupled to the condenser in order to feed compressed vapor into the condenser, and wherein the condenser further has a heating forward flow for supplying warm heating liquid and a heating return flow for supplying cold heating liquid to the condenser.

According to another embodiment, method for evaporating an operating liquid may have the steps of arranging an operating liquid to be evaporated on an evaporator surface; and generating turbulences in the operating liquid to be evaporated on the evaporator surface.

According to another embodiment, a method for condensing an evaporated operating liquid may have the steps of arranging operating liquid on a condenser surface; generating turbulences in the operating liquid arranged on the condenser surface; or making a vapor current directed to the condenser surface laminar so that vapor made laminar hits the operating liquid.

The present invention is based on the finding that the evaporation process may be substantially enhanced by the use of turbulence generators or vortex generators on the evaporator surface onto which an operating liquid to be evaporated is to be arranged. The turbulence generators guarantee that no layering takes place on the operating liquid on the evaporator surface. Instead, the cold liquid layer forming the surface of the operating liquid on the evaporating surface is torn apart and brought to the bottom by the turbulence generators. Simultaneously, the warmer bottom layer of the operating liquid is brought to the top, so that it is guaranteed that there is operating liquid at the surface which has a temperature at which, considering the pressure in the evaporator which is below the atmospheric pressure and advantageously even below 50 mbar, an evaporation occurs. Advantageously, the pressure is selected such that the liquid of the bottom layer which is turned up to the top by the turbulence generators is the boiling temperature of the liquid which, as is known, decreases with decreasing pressure.

At the condenser side, in one embodiment, the condensation efficiency is increased by providing turbulence generators also on the condenser surface, and these turbulence generators lead to a layering of the liquid on the condenser surface being prevented or constantly disrupted. Thus, the warmer top layer which absorbed heat from the condensation process is brought to the bottom and simultaneously cooler liquid in the condenser is brought to the top to be heated up by the condensing vapor. In another embodiment, on the condenser side a laminarization means (means for making laminar) is present which is implemented to make the vapor stream directed to the operating liquid laminar. Thus, an advantageous temperature distribution of the vapor in the laminarization means is achieved, so that a high condenser efficiency is achieved which occurs virtually independently of the temperature with which the vapor enters the condenser space. This is an advantage in particular with heat pumps with compressors, as typically vapor overheating exists which normally, without the use of a laminarizer, leads to a drastic reduction of the condenser efficiency, which is why vapor coolers are used in conventional technology. All such measures are no longer needed due to the laminarizer, as the laminarizer automatically generates a temperature profile which leads to an optimum efficiency. In one embodiment both turbulence generators and also a laminarizers are used on the condenser side, which leads to a further increase of the condenser efficiency.

According to a further embodiment, the present invention relates to an evaporator with an evaporator surface provided with turbulence generators so that a water stream has turbulences on the evaporator surface which include at least 20% of the total water current.

In a further embodiment, the present invention relates to a condenser in a condenser space, wherein the condenser space comprises a laminarizing means to make a gas current directed to a liquid surface in the condenser laminar, the laminarizer being implemented to generate a gas stream on the output side which is at least half as turbulent as a gas stream fed into the laminarizer, the condenser being provided with turbulence generators so that a water stream on the condenser surface comprises turbulences including at least 20% of the total water current.

Using simplest measures the present invention achieves a substantial increase of the evaporation efficiency and the condenser efficiency, wherein this increase may either be used to manufacture an evaporator or condenser with a higher power. Alternatively, it is however advantageous to use this substantial efficiency increase to construct an evaporator and a condenser substantially smaller and more compact, wherein, however, a certain performance is achieved. This is a great advantage, in particular for an application in a heat pump for heating a building for small and medium-sized buildings, as in buildings, and particularly in residential buildings, space is typically limited. In addition to that, a reduction of the size, due to the reduced amount of material and the easier manageability during manufacturing, leads to substantial cost savings, which is of special importance particularly for the use in heat pumps which may be manufactured on a large scale and have to be of a reasonable price for the individual clients. At the same time, turbulence generators and laminarizers may be implemented with the simplest means, thereby avoiding the use of any electronic/electric elements.

BRIEF DESCRIPTION OF THE DRAWINGS

In the following, embodiments of the present invention are explained in more detail with reference to the accompanying drawings, in which.

DETAILED DESCRIPTION OF THE INVENTION

Figure 4A:
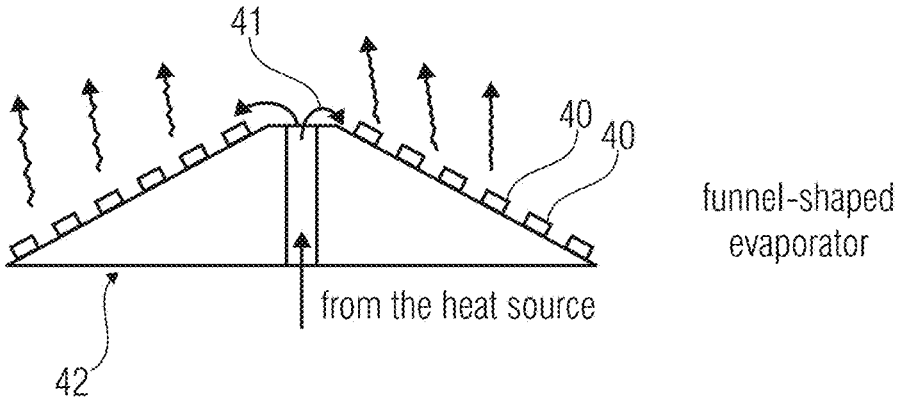
FIG. 4*a* is a schematical illustration of an evaporator with one embodiment of the present invention.
Figure 4B:
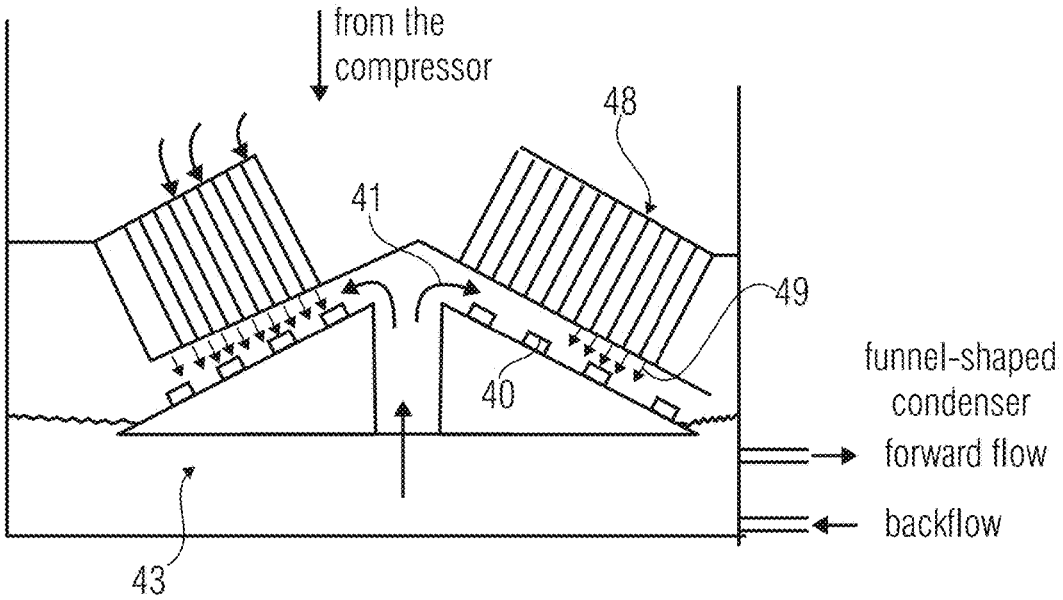
FIG. 4*b* is a schematical illustration of a condenser according to an embodiment of the present invention.

According to the invention, on the evaporator side and/or on the condenser side, a means for generating vortexes is provided. This water vortex generating means which may comprise a plurality of so-called vortex generators 40, as is illustrated in FIG. 4*a* and FIG. 4*b*, leads to the water current 41 leading to a liquid layer on a funnel-shaped evaporator 42 or a funnel-shaped condenser 43 passing across the vortex generators. This leads to the water stream which is to be evaporated or condensed being continuously subjected to turbulence or vortexes. Thus, the bottom layer of the water film is continuously mixed with the top layer of the water film.

Figure 1:
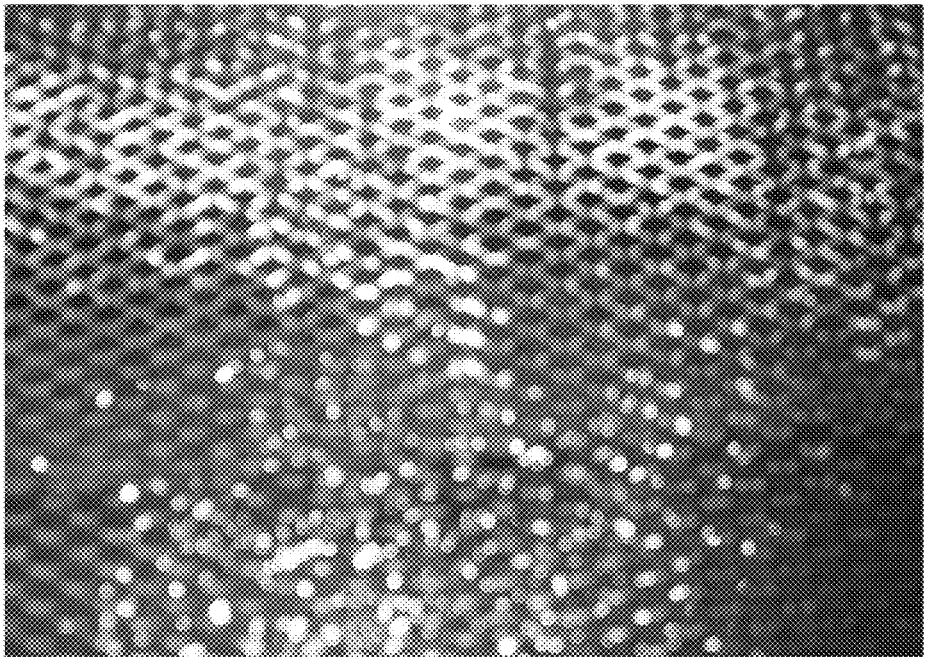
FIG. 1 is a top view onto a condenser or evaporator having turbulence generators in the form of a simple wire mesh fence.

For so-called vortex generators, different materials may be used, like, for example, a wire mesh fence, as is schematically illustrated in FIG. 1. This wire mesh fence is arranged in the water stream or water current so that the wire represents an obstacle for the water current and continuously leads to a division of the flow and, so to speak, to a "folding", and thus to a vortex generation in the water layer.

The wire mesh illustrated in FIG. 1, which is also known as "chicken wire", comprises turbulence cells with a diameter of between 0.5 mm and 3 mm and 1 mm, wherein the distance between these turbulence cells is approximately one to ten times the diameter of a turbulence cell or a vortex generator.

It is to be noted that any other vortex generators may be used, like, for example, pyramids arranged on the funnel-shaped evaporator which, so to speak, "cut up" and "fold down" the water current so that water from the bottom area of the liquid film is brought to the top and vice versa. It is thus guaranteed that, on the evaporator side which is plotted in FIG. 4*a*, "warmer" water is continuously brought to the evaporator surface and colder water, i.e. water which has already given off its energy, is mixed downwards.

With a heat pump this leads to a substantial power increase. If an evaporation power of perhaps 1 to 4 $kW/m^2$, i.e. an evaporation power per evaporator area, was achieved without a vortex generator, this evaporation power is substantially increased, i.e. into a range from 60 to 300 $kW/m^2$, wherein already with simple vortex generators, as are, for example, illustrated in FIG. 1 of the "mesh wire variant", typically 100 kW/m$^2$ is achieved. The mixing, as is achieved by the vortex generator 40, thus leads to a destruction of the layering on the funnel-shaped evaporator, and analog to that also on the funnel-shaped condenser.

Figure 2:
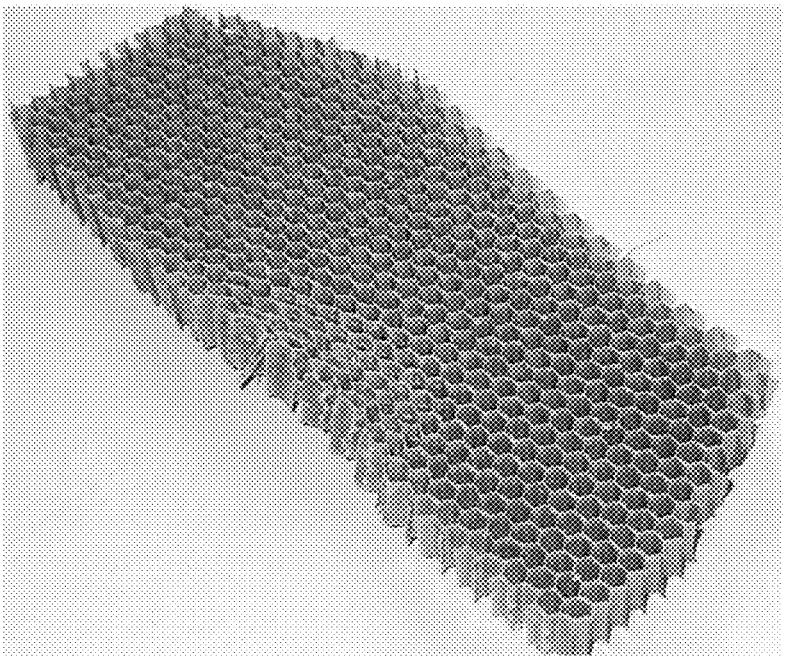
FIG. 2 is a honeycomb structure for implementing a laminarizer in the condenser.

Although it was noted that the vortex generators may be used both in the evaporator and also in the condenser, the condenser power may be increased also without a vortex generator 40 if a gas current laminarizer 48 is used. Such a gas current or gas stream laminarizer may, for example, be achieved by a honeycomb-shaped material in the form of a honeycomb, as is illustrated in FIG. 2. It has turned out that with a honeycomb cell with a diameter of 3 mm and a honeycomb length of 8 mm already a gas stream laminarization is achieved, which leads to the gas stream 49, as it exits the laminarizer 48, being a laminar current. The condenser efficiency of this laminar current is substantially higher compared to a situation in which the non-laminarized gas stream hits the liquid film of the funnel-shaped condenser. The reason for this is that overheating effects in the gas which is supplied from the compressor into the condenser, as is illustrated in FIG. 4*b*, may be retained.

Thus, the gradient of the temperature as a function of the location is very high in the case of a non-laminar current at the liquid surface. By the inventive laminarization of the gas current, however, a smaller gradient is achieved directly at the liquid surface. Thus, the energetic ratios of the gas better suit the energetic ratios of the liquid, so that the efficiency of the condensation process is essentially increased.

The laminarization means is used together with the vortex generators 40 to achieve an even higher condenser power. However, also without vortex generators on the condenser side or without a laminarizer 48 on the condenser side, the efficiency is already substantially increased.

According to the invention it is, however, advantageous, on the condenser side, to use both the vortex generators 40 in the liquid layer and also the laminarizer 48 for making the current of the gas laminar. Thus, condenser powers may be achieved which are up to 100 times higher than condenser powers without vortex generators and/or laminarizers.

In FIG. 1, as was already mentioned above, a wire mesh is illustrated as a vortex generator which is surrounded by water, which leads to a turbulence generation occurring in the operating liquid, which does not necessarily have to be water, but which is advantageously water. This leads to a very even temperature distribution in the fluid stream flowing off. With a laminar current, i.e. without the wire mesh as an example of a turbulence generator, however only a cooling at the surface takes place.

The honeycomb structure illustrated in FIG. 2 for making the gas current laminar serves to achieve a smoother temperature gradient to the fluid surface. Thus, a statistically higher probability of finding molecules with the suitable energy amount for condensing at the surface results. If, however, a turbulent gas stream is used, as is conventionally provided from a compressor and in particular a turbo compressor, an extremely steep temperature gradient results and condensing is thus strongly obstructed.

Figure 3:
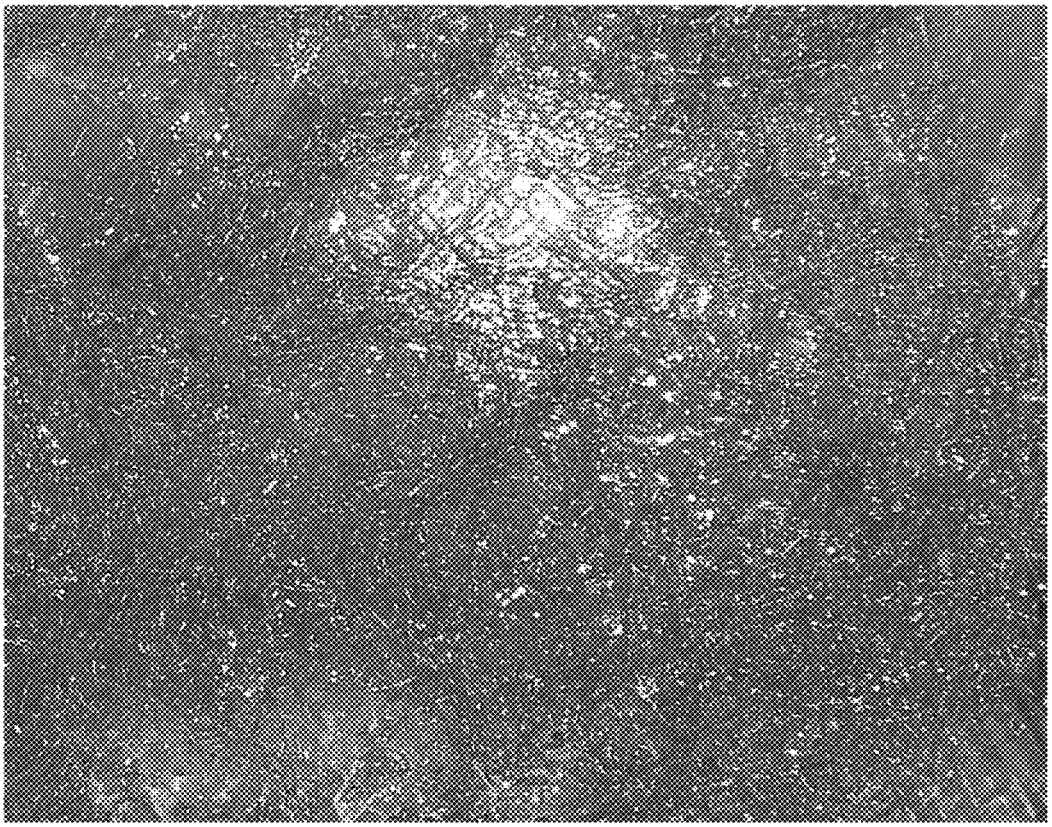
FIG. 3 is a top view onto a turbulent operating liquid in a condenser beneath an evaporator.

FIG. 3 shows turbulent water (fluid) on a condenser to increase the condenser power.

Figure 5:
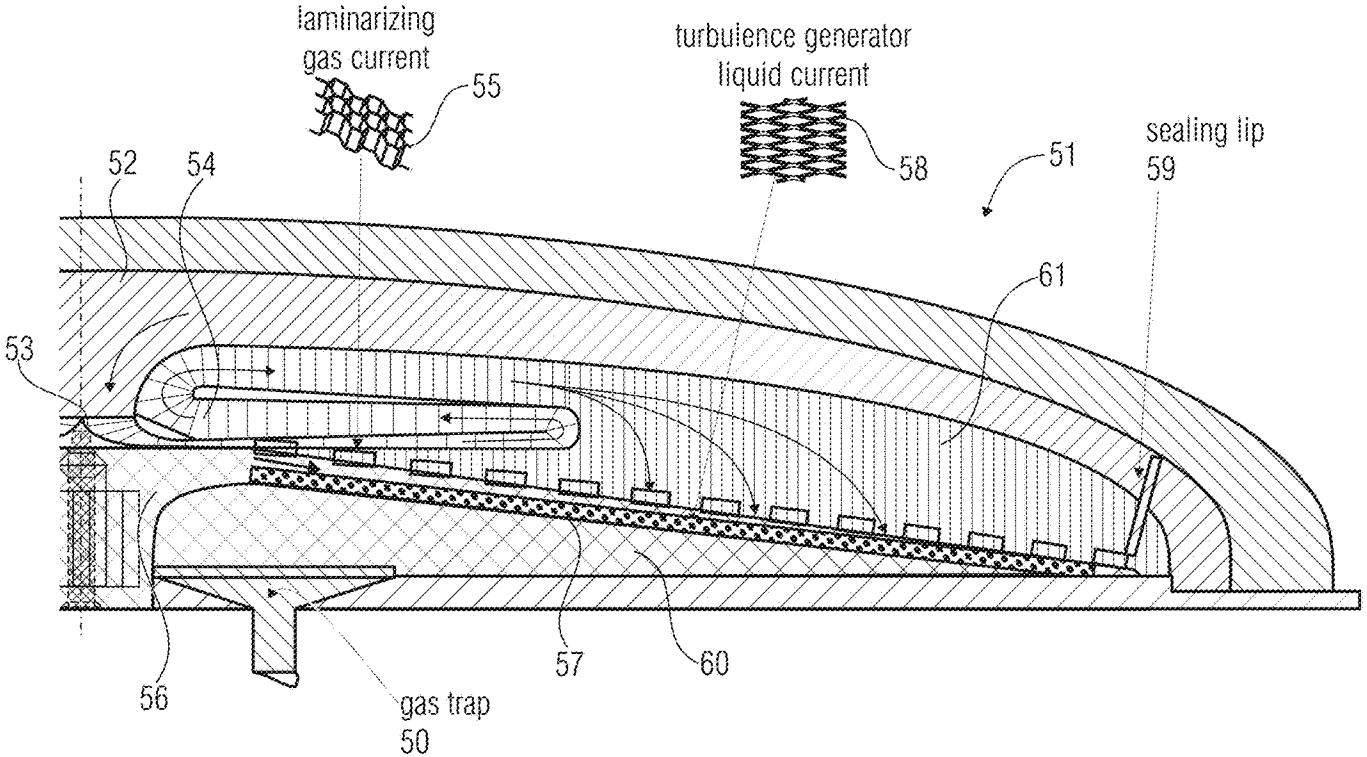
FIG. 5 is an overview diagram for illustrating a liquefier with a gas removal device according to an embodiment of the present invention.

An arrangement of a device, which is also referred to as a gas trap 50, in the liquefier 51 of a heat pump is illustrated in FIG. 5. In particular, FIG. 5 shows a heat pump in which the liquefier is arranged on top of an evaporator although this arrangement does not necessarily have to be used to implemented a gas trap. Water vapor enters a compressor 53 via a first gas channel 52 and is compressed there and output via a second gas channel 54. The discharged gas, i.e. the compressed and thus hot water vapor is advantageously directed to condenser water through an inventive laminarization means 55 which may, for example, be implemented in a honeycomb shape or in another way, wherein the condenser water runs off to the side via a condenser water channel 56 via a plate-shaped or funnel-shaped condenser drain 57. It is to be noted that the condenser drain 57 is typically rotationally symmetric and provided with an inventive turbulence generator 58 to increase the condenser efficiency.

Foreign gases sucked in by the compressor motor 53 from the evaporator are directed, due to the gas current through the laminarizer 55, to the condenser water 56, which runs off to the side coming from the center over the turbulence generator 58 which may, for example, be implemented in the form of a wire mesh. It has turned out that foreign gases are carried off to the side by the condenser water between the laminarizer 55 and the condenser water surface.

For the foreign gases to accumulate in the proximity of the gas trap 50, a sealing lip 59 is provided which separates the bottom gas area 60 from the top gas area 61. Thus, the sealing lip 59 does not necessarily have to provide a complete sealing. It guarantees, however, that the foreign gas transported by the condenser water on the condenser 57 accumulates below the condenser drain 57 in the area 60. Foreign gases, as they are heavier than water vapor, fall into the gas trap 50 due to gravity. A diffusion process acts against gravity, insofar as also the foreign gases want to have the same concentration in the area 60 and in the gas trap. This diffusion process thus acts against the gravity effect of the gas trap. This is relatively unproblematic, however, as the accumulation of the foreign gas now no longer takes place in the area where condensation takes place, but below the drain 57. By the sealing lip 59, it is prevented that the concentrations in the area 60 and in the area 61 are set to the same value. Thus, the concentration of the foreign gas in the space 60 will be higher than in the space 61, and a good trapping effect for foreign gases will occur in the gas trap 50.

The effect of the sealing lip 59, which separates the area above the condenser drain or the condenser funnel 57 from the area below this element 57, is increased by the fact that the laminarization means 55 is present, as thus the foreign gases, as soon as they meet the water current 56 on the liquefier drain 57, may not leave again, but are forced, so to speak, to pass in the direction of the sealing lip and below the sealing lip to accumulate in the proximity of the gas trap 50. This performance is even increased by the turbulence generator 58 as then a more turbulent current exists which also has a higher efficiency, so to speak, to trap and carry foreign gas which is in the top area 61.

Figures 6A, 6B:
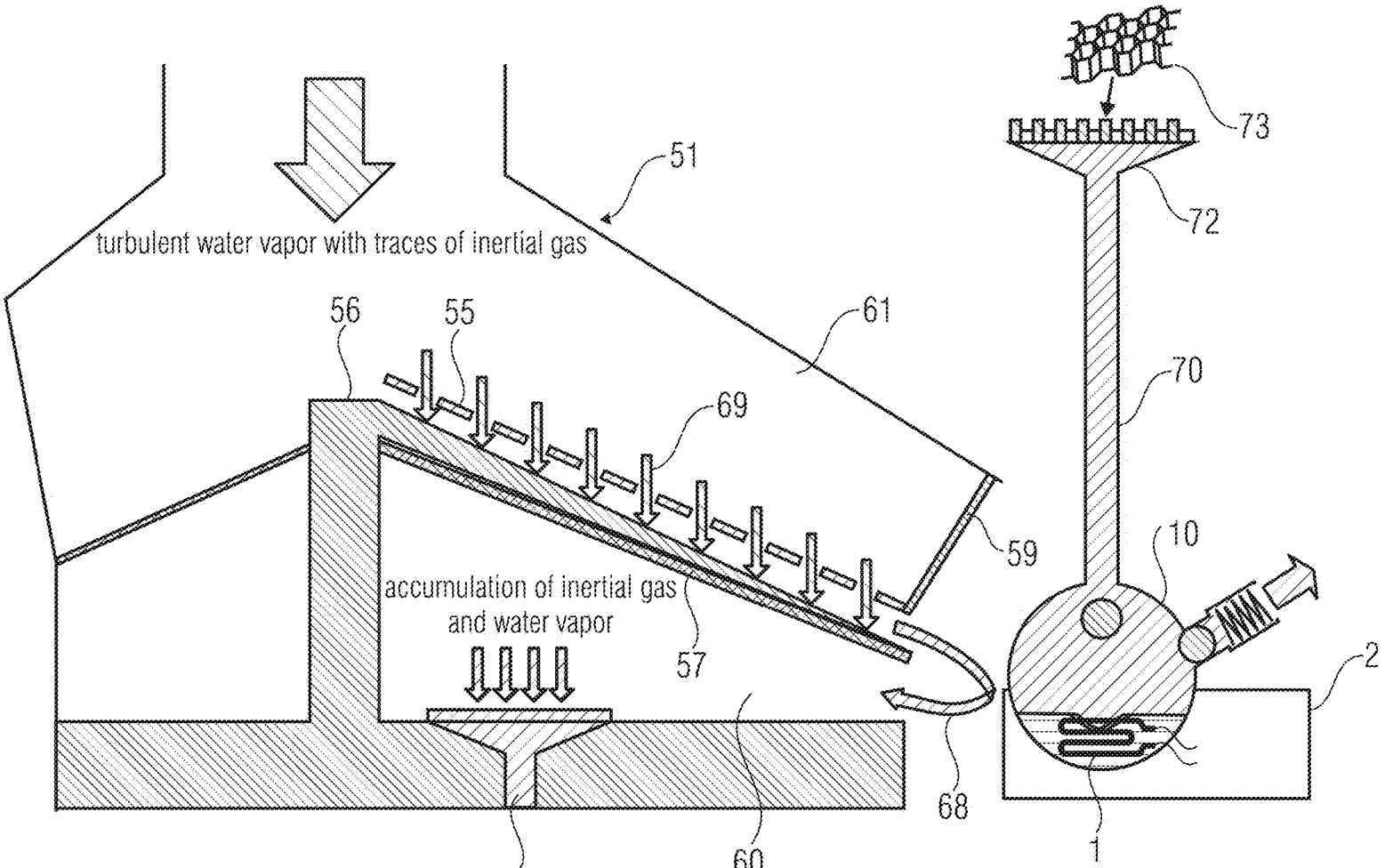
FIG. 6*a* is a plot for illustrating the functionality of the gas removal device at an inventive condenser.
FIG. 6*b* is a detailed illustration of the gas removal device.

FIG. 6*a* shows a basic illustration of the functionality which was illustrated in respect of the heat pump or the heat pump liquefier 51 of FIG. 5. In FIG. 6*a* it is particularly emphasized how the space 260 below the drain 57 is separated from the top area 61 by the sealing lip 59. This separation, as is clearly obvious in FIG. 6*a*, does not have to be hermetic as long as a higher probability exists that foreign gases follow the turbulent water vapor, which was, however, laminarized by the laminarizer 55, as is illustrated by arrows 69, on the path into the lower area 60, as is indicated by an arrow 68, with a higher probability in comparison to the probability that the foreign gases again enter the top area 61. Thus, in the area 60 an accumulation of foreign gases will take place, so that the diffusion effect is, so to speak, reduced from the gas trap 50 and the efficiency of the gas trap is not substantially affected.

It is advantageous, depending on the implementation, to implement the gas trap similar to FIG. 6*b*. For this purpose, the gas trap has a relatively long neck 70 which extends between the accumulation container 71 and an existing inlet area 72 which may be funnel-shaped. However, it is not the length of the neck 70 that is important, but that at least the bottom part of the accumulation container 10 is arranged in a cold area, like, for example, the evaporator 2 of the heat pump. This means that warm water vapor from the area 60 of the liquefier comes into contact with a cold surface of the accumulation container 1, which leads to a condensation of the water vapor. Thus, a continuous water vapor current into the funnel 72 along the neck 70 into the accumulation container results, as the water vapor in the area 50 condenses at the cold wall of the accumulation container arranged in the evaporator 2. The thus resulting current into the gas trap serves, on the one hand, to carry also foreign gases into the accumulation container and at the same time serves to accumulate water in the accumulation container which may then be heated up by the pressure generating means 1 in the form of a heating coil to cause the vapor output. Also at the funnel opening, a laminarization means 73 is arranged, like, for example, in the form of a honeycomb-shaped structure in order to improve the efficiency of the gas trap.

The implementation of arranging a wall of the accumulation container 10 in the evaporator, or, generally speaking, at a cold location of the system, is especially advantageous when the heat pump is implemented such that the liquefier is arranged above the evaporator. In this implementation, the neck 70 reaches through the liquefier downwards into the evaporator to provide a cold condensation wall which, on the one hand, leads to a continuous gas stream into the gas trap and, on the other hand, causes water to be present in the gas trap, which may be heated to increase the pressure in the accumulation container such that at certain events a discharge of foreign gas may take place.

Figure 7:
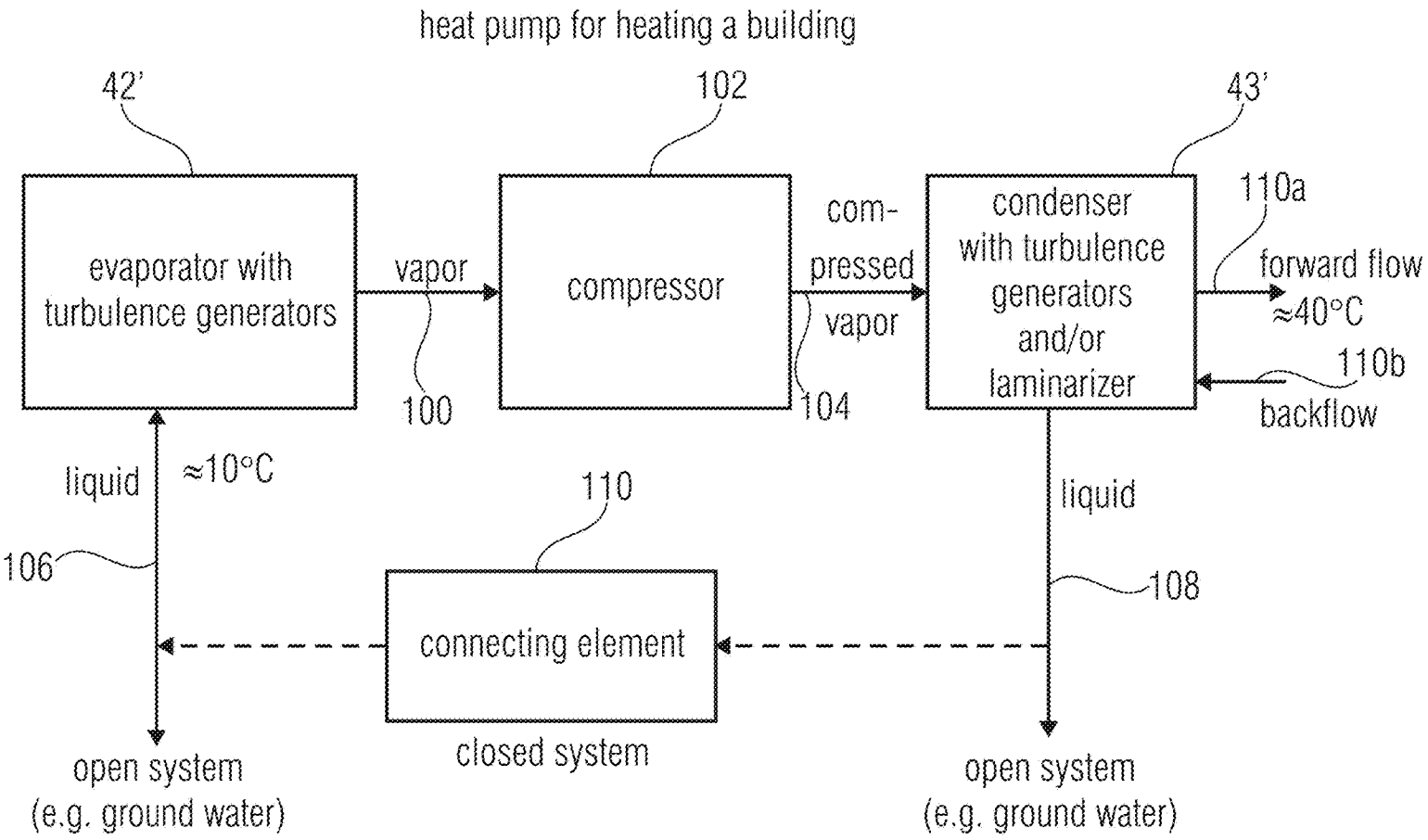
FIG. 7 is a schematical illustration of a heat pump with an evaporator according to one embodiment of the present invention and/or a condenser according to one embodiment of the present invention.

FIG. 7 shows a schematical illustration of a heat pump for heating a building. The heat pump for heating a building is implemented such that detached houses or small apartment houses may be heated. The heat pump for heating buildings according to one embodiment of the present invention is to be implemented to heat small apartment houses with less than 10 apartments and advantageously less that 5 apartments. The heat pump includes an evaporator with an evaporator housing 42' with turbulence generators. The vapor generated in the evaporator is supplied via a vapor line 100 to a compressor 102. The compressor 102 compresses the vapor and leads the compressed vapor via a vapor line for compressed vapor, designated by 104, into an inventive condenser having a condenser housing 43' which comprises either turbulence generators or a laminarizer or advantageously both means to acquire a more efficient condensation. The evaporator receives the liquid to be evaporated via a supply line 106 and the condenser discharges the condensed liquid via a discharge line 108. In addition to that, the condenser 43 comprises a forward flow 110*a* with temperatures, for example, in a range of 40° for floor heating and a return flow 110*b* from the heating system of the building. In the radiator, such as, for example, the floor heating or a wall heating element, the same liquid may flow as in the condenser without a heat exchanger being provided. Alternatively, however, also a heat exchanger may be provided so that the forward flow 110*a* and the return flow 100*b* lead to a heat exchanger not illustrated in FIG. 7 and not into an actual radiator. The discharge line 108, in the case of an open system, may lead into an open water reservoir, like, for example, ground water, sea water, saline water, river water, etc. Likewise, in such an open system the supply line 106 may come from underground water, sea water, river water, saline water, etc. Alternatively, also a closed system may be used, as is indicated by the dashed connecting lines to a connecting element 110. In this case, the connecting element 110 guarantees that the liquid condensed in the condenser is again supplied into the evaporator, wherein corresponding pressure differences are considered.

It is further to be noted that, in the case of a half-open system, although the liquid 106 in the supply line carries heat from the underground water, it is not underground water, wherein in this case a heat exchanger is arranged in an underground water reservoir to heat up the circulating liquid in the line 106, which is then implemented as a go and return line so that the heat transmitted by the underground water is brought into the heating forward flow 110*a* via the heat pump process.

In an embodiment of the present invention, the operating liquid in the evaporator and in the condenser is water. Alternatively, however, also other operating liquids may be used, like, for example, heat-carrier liquids provided especially for heat pumps. Water is, however, advantageous due to its special suitability for the process. A further substantial advantage of water is that it is carbon neutral.

To evaporate water at temperatures of approximately 10° C., the evaporator 42 is provided with an evaporator housing which is implemented to maintain a pressure in the evaporator at least in the environment of the evaporator surface at which the water flowing in the supply line 106 evaporates. If water is used as the operating liquid, pressures in the evaporator will be below 30 mbar and even in a range below 10 mbar.

On the condenser side, pressures will be at more than 40 mbar and below 200 or 150 mbar. In this respect a condenser housing is implemented to maintain the respective pressures. Pressures at condensation temperatures of 22° C. or above are advantageous.

Figure 8A:
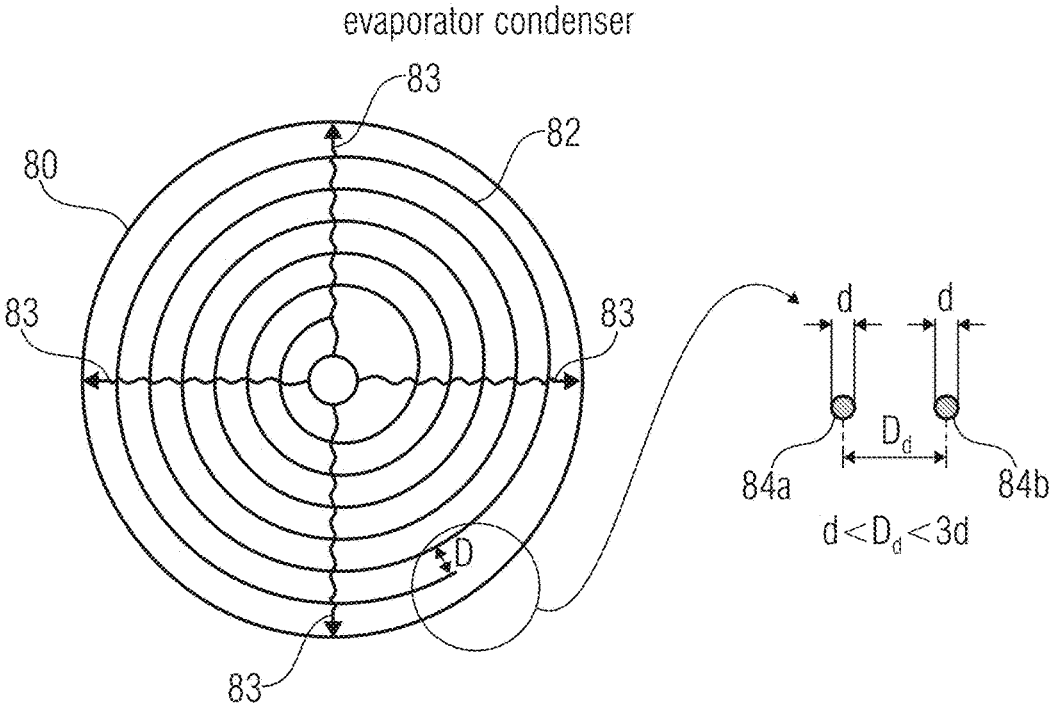
FIG. 8*a* is a top view onto an evaporator or condenser.
Figure 8B:
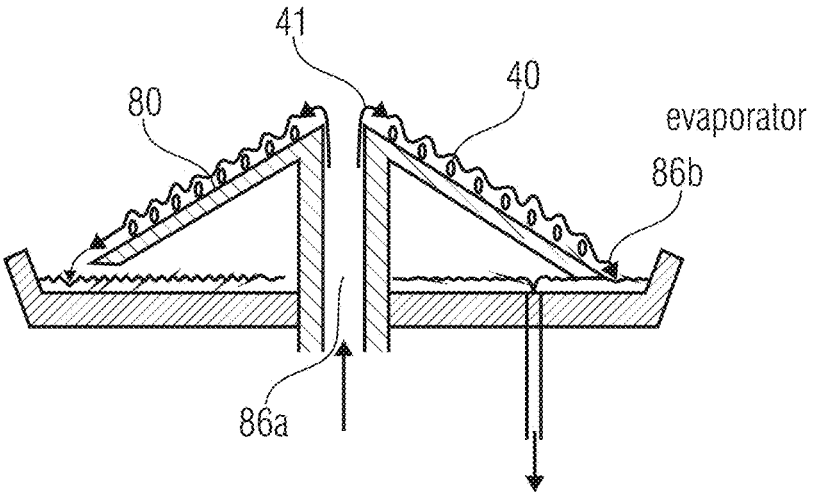
FIG. 8*b* is a longitudinal section of an evaporator.

FIG. 8A shows a top view onto an evaporator or condenser with wire sections as turbulence generators, and FIG. 8B shows a longitudinal section of the evaporator, which, analogous to this, may also be the condenser if corresponding forward/return lines, etc. are considered and the condenser liquid is not externally supplied and drained but circulates.

The evaporator includes an evaporator surface or condenser surface 80 arranged on the turbulence generators 40. The turbulence generators 40 are individual wire sections, together implemented, for example, as a spiral 82. Simultaneously, the turbulence generators may also be more or less concentric wire rings separate from each other, but the use of a spiral is easier with regard to handling and assembly. In the flow direction of the operating liquid, indicated with the symbolic arrows 83, adjacent wire sections 84*a*, 84*b* which each have a diameter of d are spaced apart by a distance $D_d$, wherein the distance $D_d$ is greater than the diameter d of a wire section and advantageously smaller than three times the diameter. Although the wire sections in FIG. 8A are plotted having a circular cross-section, the cross-section of the wire sections is arbitrary.

In the longitudinal section, FIG. 8B shows a funnel-shaped evaporator or condenser or a funnel-shaped evaporator surface or condenser surface 80. The wire sections are mounted directly on this surface 80. Alternatively, the wire sections may also be spaced apart, as long as a relative positioning of the turbulence generators 40 with respect to the surface 80 is provided which is such that it acts upon the operating liquid present on the surface 80 by means of the turbulence generators, so that turbulences result.

The surface 80, both for the evaporator and also for the condenser, is shaped such that the operating liquid which is supplied via an operating liquid supply line 86 not only stands still on the surface 80, which would be the case if the surface were completely horizontal and a virtually non-existing supply line were present, but that the operating liquid also flows on the surface due to gravity. For this purpose, the surface 80 includes at least one inclined plane. Advantageously, the surface is funnel-shaped and the supply opening 86 is in the center or arranged with respect to the operating surface such that the operating liquid is not only drained at one side with respect to the supply opening, but flows off to all sides. Alternatively, however, also an implementation for certain applications may be used, in which, for example, a level area exists which is arranged as an inclined plane and where, at the highest point, the intake or supply line 86 is arranged so that the operating liquid is not on several sides of the intake but basically in a limited sector, like, for example, 30°, 60° or 90° with respect to the intake on the surface, in order to cause an effect there by the turbulence generators 40.

Alternatively, the operating surface may also be pyramid-shaped or conical or uneven or curved in its cross-section as long as the operating liquid, in the operating position of the evaporator or condenser, overcomes a height difference due to the effect of gravity.

Figure 9A:
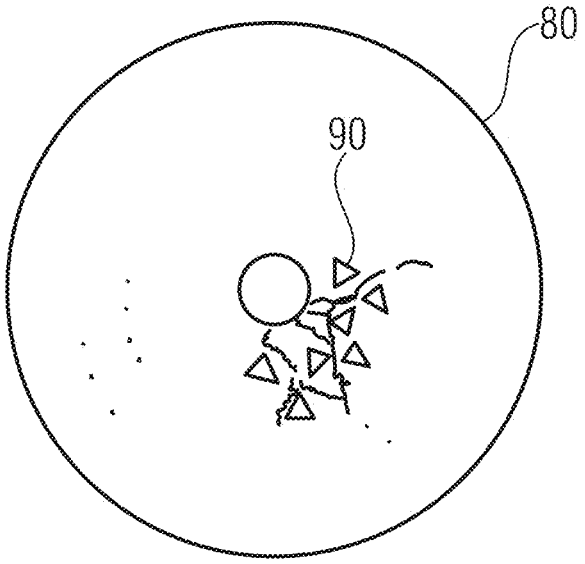
FIG. 9*a* is a top view onto an evaporator or condenser according to an alternative embodiment of the present invention.
Figure 9B:
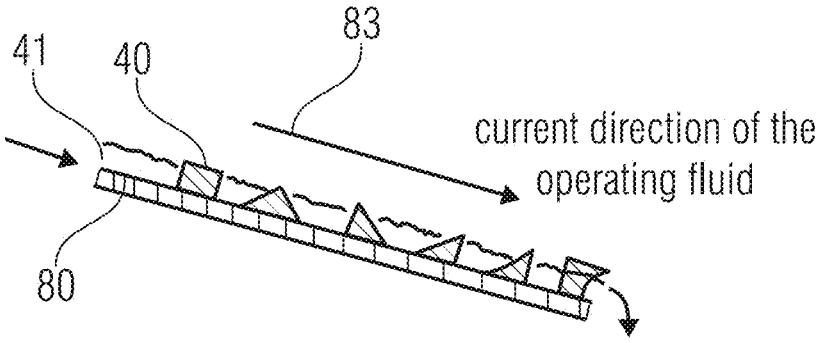
FIG. 9*b* is a schematical cross-sectional illustration of an evaporator or condenser according to an embodiment of the present invention.

FIGS. 9A and 9B show a top view onto an alternative surface 80 of an evaporator or condenser, wherein no wire sections as in FIG. 8A exist but elevations or indentations exist in the operating surface. In FIG. 9B, only elevations are illustrated. The indentations will be implemented similarly but, so to speak, "negatively" with respect to the illustrated elevations. The turbulence generators 40 protrude from the surface or are set back from the surface, i.e. practically as "holes" in the surface 80, wherein the turbulence generators 40 protrude so far over the surface that they protrude, at least with their tip, beyond a level of the operating liquid 41 on the surface 80. Further, the turbulence generators 40 may have any shape, as indicated in FIG. 9B. The more abrupt the shapes are, the more "whirls" or turbulences are generated. Simultaneously, the turbulence generators may also be implemented to achieve, using special forms, a "separation" and "folding" of the water current.

Apart from the illustrated implementations, the turbulence generators may, for example, also be implemented by elements reaching into the operating liquid, like, for example, bars, etc. which are not firmly connected to the surface 80 but are suspended above the surface 80, for example. These bars may also be moved, depending on the implementation, to generate extremely strong turbulences. Turbulences may thus be generated in many ways, wherein turbulence generators, in order to generate these turbulences, may be firmly connected with the operating surface 80 or also be positioned in a static or dynamic way with respect to the operating surface as long as, advantageously, at least 20% of the overall water current is provided with turbulences. It is advantageous in special embodiments to provide almost the complete operating surface of the evaporator or condenser with turbulence generators as far as possible, so that between 90% and almost 100% of the complete current is turbulent or, with respect to the area of the surface 80, more than 80% or more than 90% of the liquid on the surface 80 is in turbulence.

Figure 10A:
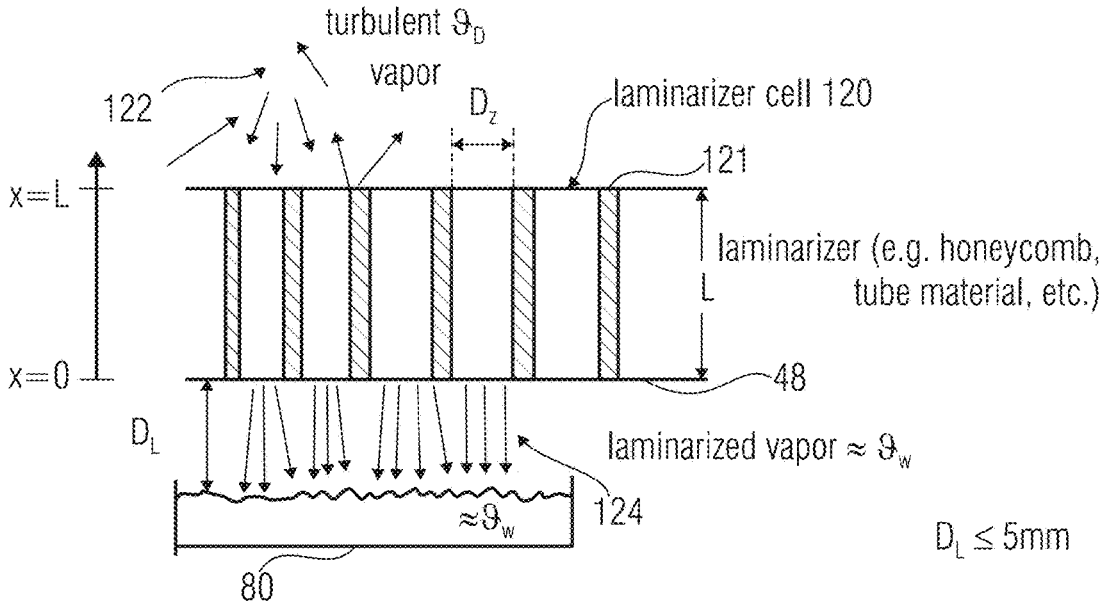
FIG. 10*a* is a cross-section through a laminarizer according to an embodiment of the present invention.
Figure 10B:
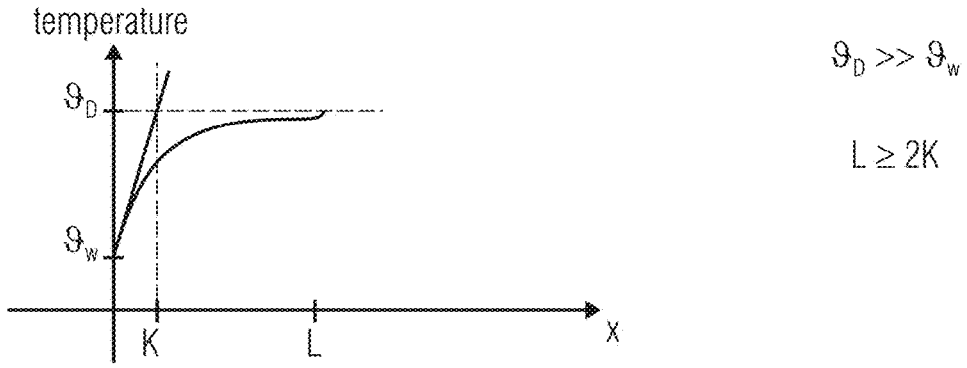
FIG. 10*b* is an illustration of the temperature along the path in a laminarizer cell of the laminarizer.

FIG. 10A shows a cross-section through a laminarizing means having different laminarizing cells 120. Above the laminarizing cells 120, turbulent vapor with a temperature $\theta_D$ exists, as is schematically indicated by the undirected vapor arrows 122. Below the laminarizer cells 120, however, vapor 122 made laminar is illustrated which, due to the fact that it is close to the liquid of the condenser on the condenser surface 80, has a temperature of about $\theta_W$. $\theta_W$ is lower than $\theta_D$. The course of the temperature in a laminarizer cell of x=0 to x=L is schematically illustrated in FIG. 10B. An exponential connection may be seen, wherein the temperature at x=0 is approximately $\theta_W$ and via an approximately exponential connection reaches the temperature $\theta_D$ at x=L. This connection is characterized by a position constant K indicated in FIG. 10B. For a good laminarization and thus a good temperature distribution to take place, it is advantageous to implement the length of a laminarizer cell 120 to be at least so large that the length is greater or equal 2K.

In addition to that, with the present invention the temperature of the undirected vapor $\theta_D$ may be far higher than the temperature of the water $\theta_W$. Still, no vapor coolers, etc. are needed, as the laminarizer 48 with the individual laminarizer cells 120 separated from each other by walls 121 enforces the temperature distribution illustrated in FIG. 10*b*. In the embodiment, the laminarizer is honeycomb-shaped or made of a tube material, as long as individual laminarizer cells 120 exist which are directed in a more or less parallel way and are smooth on the inside and which cause a laminarization as is illustrated by the directed vapor current 124.

The laminarizer does not necessarily have to achieve a perfect 100% laminarization as long as the gas current at the output of the laminarizer is less turbulent than the gas stream at the input of the laminarizer. Advantageously, the laminarizer cells or the whole laminarizer is implemented so that the output vapor current made laminar is at least half as turbulent as the turbulent vapor current on the input side.

For use in a condenser for a heat pump operated with water as the operating liquid, it is advantageous for the length of a laminarizer cell 120 to be approximately 10 mm long if the diameter of the laminarizer cell is 5 mm. The larger the diameter of an individual cell, the longer also the length L ought to be, so that also with larger diameters a sufficient laminarization is achieved. At the same time, with smaller diameters there is a lower limit of the length in order to prevent a nozzle effect occurring which may lead to a de-laminarization. To keep the flow resistance for the vapor as low as possible, it is advantageous to provide a large laminarizer area and to implement the thickness of the walls 121 between the laminarizer cells 120 in FIG. 10A as low as possible. Advantageously, if the diameter is smaller than 1 mm, the length is longer than 1 mm. Other favorable exemplary dimension are: if the diameter is greater than 5 mm, the length is greater than 10 mm, and if the diameter is smaller than 5 mm, the length is smaller than 10 mm.

In order to guarantee, also with incomplete laminarization, that a basically laminarized current meets the liquid on the condenser surface, it is advantageous to implement the distance $D_L$ between the output of the laminarizer cells 120 and the surface of the liquid to be relatively small and in particular smaller than 50 mm, advantageously smaller than 25 mm or advantageously smaller than 6 mm. It is thus also enforced that the gas or the evaporated operating liquid when it leaves the laminarizer cells has a temperature which is virtually equal to or only slightly higher than the temperature of the water. It is thus guaranteed that the vapor particles in the current do not "bounce off" the water or again act as vapor generators but are integrated into the water by condensation, as only in this way an especially efficient heat transmission from vapor to water may take place.

The inventive laminarizer provides a substantial increase of the efficiency when condensing. In conventional technology without laminarizers, the efficiency of power per area strongly decreased the higher the temperature of the vapor with respect to the temperature of the condenser liquid. It may thus be said that, when overheating the vapor by 10°, only 10% of the condenser power was possible. This consequently led to condenser powers of 2-3 kW per $m^2$ for a typical surface condensation or evaporation. According to the invention, with the same area a substantially higher power is achieved depending on the implementation of 40-200 $kW/m^2$ or even more. This means increasing the efficiency by a factor of 20 with simple means. A further advantage is that the efficiency is relatively independent of the temperature of the undirected vapor. It is thus easily possible according to the invention to condense vapor with a temperature of, for example, more than 150° C. with water which is, for example, at 40° C. The laminarizer thus provides a decoupling of the condenser efficiency from the vapor temperature at the output of the compressor. Thus, the compressor may be dimensioned according to its requirements, and it does not have to be considered in the dimensioning of the compressor according to the present invention which thermal conditions are needed for condensing.

Deviating from the above-described embodiments, the turbulence generators and the laminarizing means may not be implemented as two separate elements but also as one and the same element. For example, a fiber tissue or a fiber mat advantageously made of non-absorbent fibers may be placed onto the evaporator surface or the condenser surface, wherein the surface of the fiber tissue protrudes from the level of the liquid, advantageously by more than 3 mm and in particular by more than 5 mm. The liquid flows around the fibers, whereby turbulences are generated. The washed-around fibers represent the turbulence generators. The fibers protruding from the liquid which are not washed-around do, however, represent the laminarization means. The friction of the vapor at the fibers, which do not necessarily have to be directed, leads to a laminarization of the vapor. The material of the fibers is plastic or metal, and the fiber tissue is, for example, metallic wool or, in particular, steel wool. An advantage of this implementation is that this implementation is self-adjusting, as the separation into turbulence generator and laminarization means is automatic and is defined by the current liquid level. Apart from that, the assembly is especially simple and thus cost-effective.

Although certain elements have been described as device features, at the same time this should represent a description of the corresponding method step.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A condenser condensing an evaporated operating liquid, comprising:

a condenser surface on which an operating liquid is arranged;

a plurality of turbulence generators generating current turbulences in the operating liquid located on the condenser surface; and a laminarizer making a vapor current of the evaporated operating liquid and directed to the operating liquid located on the condenser surface laminar, wherein the vapor current of the evaporated operating liquid made laminar by the laminarizer is warmer than the operating liquid located on the condenser surface, wherein the vapor current of the evaporated operating liquid made laminar by the laminarizer impinges on the current turbulences in the operating liquid located on the condenser surface and generated by the plurality of turbulence generators, and wherein the vapor current of the evaporated operating liquid made laminar by the laminarizer directly condenses into the current turbulences in the operating liquid located on the condenser surface, whereby the operating liquid is heated.

2. The condenser according to claim 1, comprising:

a condenser housing in which the condenser surface is arranged, the condenser housing maintaining a pressure in the condenser housing at the condenser surface, the pressure being at such a value that a condensed operating liquid has a predetermined minimum temperature.

3. The condenser according to claim 2, wherein the predetermined minimum temperature is higher than or equal to 22° C.

4. The condenser according to claim 1, wherein the condenser surface is inclined in an operating position, wherein the operating liquid is supplied to the condenser surface, wherein the operating liquid flows from an intake for the operating liquid to a drain of the condenser surface due to gravity.

5. The condenser according to claim 4, wherein the condenser surface is pyramid-shaped, conical, funnel-shaped or in the form of an inclined plane which is level or non-level.

6. The condenser according to claim 4, wherein the intake for the operating liquid to the condenser surface is surrounded by the condenser surface, wherein the operating liquid flows across the condenser surface at several sides of the intake.

7. The condenser according to claim 1, wherein both the turbulence generators and also the laminarizer are formed by a same element.

8. The condenser according to claim 7, wherein the same element comprises a fiber tissue protruding beyond an operating liquid level on the condenser surface.

9. The condenser according to claim 8, wherein the fiber tissue is a plastic wool with non-absorbing fibers or a metallic wool.

10. The condenser according to claim 1, wherein a distance of the laminarizer from the operating liquid on the condenser surface, which the laminarized vapor has passed, is smaller than 25 mm.

11. The condenser according to claim 10, wherein the laminarizer is formed of honeycomb material or a tube material with laminarizer cells, wherein a length of a laminarizer cell is implemented such that, in proportion to a diameter of the laminarizer cell, on the output side a gas current is generated which is at least half as turbulent as a gas current which is fed into the laminarizer.

12. The condenser according to claim 11, wherein the laminarizer cell is longer than 10 mm if it has a diameter greater than 5 mm and is longer than 1 mm if it has a diameter smaller than 1 mm.

13. The condenser according to claim 1, wherein the condenser surface is formed in a tilted manner, so that the operating liquid flows off the condenser surface subsequent to being heated due to the direct condensation of vapor current of the evaporated operating liquid into the operating liquid located on the condenser surface, wherein the condenser further comprises an operating liquid reservoir into which the operating liquid flowing off the condenser surface is introduced, and wherein the operating liquid reservoir is arranged in such a way that operating liquid stored in the operating liquid reservoir and being cooler than the operating liquid flowing off the condenser surface is supplied from the operating liquid reservoir to the condenser surface to form an operating liquid current on the condenser surface.

14. The condenser according to claim 1, which is implemented for being used in a heat pump.

15. The condenser according to claim 1, which is implemented for the use of a heat pump for heating a building for buildings with less than 10 apartment units.

16. A condenser of claim 1, wherein the operating liquid is water.

17. A heat pump, comprising:

an evaporator evaporating an operating liquid, the evaporator comprising:

an evaporator surface on which the operating liquid evaporated by the evaporator is arranged; and a plurality of first turbulence generators generating turbulences in the operating liquid evaporated on the evaporator surface;

a condenser condensing the evaporated operating liquid, the condenser comprising:

a condenser surface on which the operating liquid is arranged;

a plurality of second turbulence generators generating current turbulences in the operating liquid located on the condenser surface; and a laminarizer making a vapor current of the evaporated operating liquid and directed to the operating liquid located on the condenser surface laminar, wherein the vapor current of the evaporated operating liquid made laminar by the laminarizer is warmer than the operating liquid located on the condenser surface, wherein the vapor current of the evaporated operating liquid made laminar by the laminarizer impinges on the current turbulences in the operating liquid located on the condenser surface and generated by the plurality of turbulence generators, and wherein the vapor current of the evaporated operating liquid made laminar by the laminarizer directly condenses into the current turbulences in the operating liquid located on the condenser surface, whereby the operating liquid is heated; and a compressor compressing the operating liquid evaporated by the evaporator, wherein the compressor is coupled to the condenser and feeds compressed vapor into the condenser, and wherein the condenser further comprises a heating forward flow supplying warm heating liquid and a heating return flow supplying cold heating liquid to the condenser.

18. A method of condensing an evaporated operating liquid, comprising:

arranging operating liquid on a condenser surface;

generating turbulences in the operating liquid arranged on the condenser surface; and making a vapor current of the evaporated operating liquid and directed to the operating liquid located on the condenser surface laminar, wherein the vapor current of the evaporated operating liquid made laminar is warmer than the operating liquid located on the condenser surface, wherein the vapor current of the evaporated operating liquid made laminar impinges on the current turbulences in the operating liquid located on the condenser surface, and wherein the vapor current of the evaporated operating liquid made laminar directly condenses into the current turbulences in the operating liquid located on the condenser surface, whereby the operating liquid is heated.

* * * * *